US007367084B2

(12) United States Patent
Schwarz et al.

(10) Patent No.: US 7,367,084 B2
(45) Date of Patent: May 6, 2008

(54) DEVICE FOR SUCKING UP PARTICLES TO BE COLLECTED AND A FLOOR VACUUM CLEANER

(75) Inventors: Heribert Schwarz, Bad Neustadt (DE); Thomas Seith, Bad Neustadt (DE); Artur Weigand, Niederlauer (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 135 days.

(21) Appl. No.: 10/816,369

(22) Filed: Apr. 1, 2004

(65) Prior Publication Data

US 2004/0187251 A1 Sep. 30, 2004

Related U.S. Application Data

(63) Continuation of application No. PCT/EP02/10601, filed on Sep. 20, 2002.

(30) Foreign Application Priority Data

Oct. 1, 2001 (DE) ..... 101 48 509

(51) Int. Cl.
*A47L 5/00* (2006.01)

(52) U.S. Cl. ..... 15/327.1; 15/327.7; 15/412; 55/DIG. 3

(58) Field of Classification Search ..... 15/327.1, 15/327.2, 327.3, 327.4, 327.6, 327.7, 350–353, 15/412; 55/372, 467, 472, 413, 414, DIG. 3
See application file for complete search history.

(56) References Cited

U.S. PATENT DOCUMENTS

| | | | | | |
|---|---|---|---|---|---|
| 2,237,499 | A | * | 4/1941 | Osterdahl | 55/376 |
| 2,503,918 | A | * | 4/1950 | Osborn et al. | 55/372 |
| 2,943,698 | A | * | 7/1960 | Bishop | 55/337 |
| 3,454,978 | A | * | 7/1969 | Kuwahara | 15/327.7 |
| 4,682,384 | A | * | 7/1987 | Prahl et al. | 15/344 |
| 5,914,416 | A | | 6/1999 | Thode | |
| 6,108,864 | A | * | 8/2000 | Thomas et al. | 15/350 |
| 6,125,501 | A | * | 10/2000 | Yip | 15/344 |
| 6,342,084 | B1 | | 1/2002 | Pezzaniti | |

FOREIGN PATENT DOCUMENTS

| | | | |
|---|---|---|---|
| DE | 44 15 005 | A1 | 11/1995 |
| DE | 198 02 345 | A1 | 5/1999 |
| DE | 10336828 | * | 3/2005 |

* cited by examiner

*Primary Examiner*—David A Redding
(74) *Attorney, Agent, or Firm*—Russell W. Warnock; James E. Howard

(57) ABSTRACT

A device for sucking up particles to be collected, in which at least one collecting compartment for collecting these particles is connected via an inlet opening of a partition to a suction device located inside at least one accommodating compartment. The collecting compartment is connected to the suction device in a manner that enables an airflow to be guided from the collecting compartment to the suction device. The partition contains, as an inlet opening, an air guiding funnel whose inlet surface forms a significant portion of the partition surface.

18 Claims, 5 Drawing Sheets

DEVICE FOR SUCKING UP PARTICLES TO BE COLLECTED AND A FLOOR VACUUM CLEANER

CROSS-REFERENCE TO RELATED APPLICATION

This application is a continuation, under 35 U.S.C. § 120, of copending international application No. PCT/EP02/10601, filed Sep. 20, 2002, which designated the United States; this application also claims the priority, under 35 U.S.C. § 119, of German patent application No. 101 48 509.3, filed Oct. 1, 2001; the prior applications are herewith incorporated by reference in their entirety.

BACKGROUND OF THE INVENTION

Field of the Invention

The invention relates to a device for sucking up particles to be collected, with at least one collection chamber for accumulating the particles and with at least one reception chamber for a suction device. The collection chamber and the reception chamber are separated from one another by a partition that has an entry orifice for an air stream from the collection chamber to the suction device.

In practice, particularly in the case of ultracompact vacuum cleaners, preferably floor vacuum cleaners, the suction power of these may be too low. This may be caused, for example, by the circuitous routing of the suction air stream due to the extremely compact configuration of the individual components inside the housing of such vacuum cleaners. Furthermore, because of the small amount of space available, the frames of such a vacuum cleaner can often incorporate only lower-powered blower assemblies or suction assemblies that have lower suction powers than conventional larger types of vacuum cleaner.

SUMMARY OF THE INVENTION

It is accordingly an object of the invention to provide a device for sucking up particles to be collected and a floor vacuum cleaner that overcomes the above-mentioned disadvantages of the prior art devices of this general type, the suction power of which, even in the case of a compact type of construction, is improved.

With the foregoing and other objects in view there is provided, in accordance with the invention, a device for sucking up particles to be collected. The device contains at least one collection chamber for accumulating the particles, a suction device, at least one reception chamber storing the suction device, and a partition separating the collection chamber from the reception chamber and having a partition surface. The partition has an entry orifice channeling an air stream from the collection chamber to the suction device. The entry orifice of the partition couples the collection chamber to the suction device in the reception chamber. An air guide funnel is provided and has an entry surface that forms a part of the partition surface.

The object is achieved, in a device of the type initially mentioned, in that the partition has, as an entry orifice for coupling the collection chamber to suction device of the reception chamber. An air guide funnel has an entry surface that forms an essential part of the partition surface.

Since the partition has as entry orifice formed from the air guide funnel, the entry surface of which forms the essential part of the partition surface, an excessive pressure loss of the air stream from the collection space or collection chamber to the suction device is largely avoided. Furthermore, as a result, an excessively troublesome generation of noise is largely avoided. This is because, the larger the selected entry surface the air guide funnel is, the less resistance opposes the air stream directed toward the suction device. It is thereby possible to have much less air turbulence in the direction of the collection space. Overall, a directed air stream from the collection space through the air guide funnel to the suction device can be provided in an improved way.

The invention relates, furthermore, to a vacuum cleaner, in particular a floor vacuum cleaner, which is configured on the principles according to the invention.

In accordance with an added feature of the invention, the air guide funnel is provided, with respect to the entry surface, in the partition such that an approximately straight suction air stream is provided from the collection chamber to the suction device in the reception chamber.

In accordance with an additional feature of the invention, the entry surface of the air guide funnel is a substantially rectangular entry surface on a same side as the collection chamber. The air guide funnel preferably narrows largely continuously in a direction of the suction device.

In accordance with another feature of the invention, the suction device has a blower with an entry orifice, and the air guide funnel has an exit surface with a substantially circular configuration and a diameter corresponding substantially to the entry orifice of the blower of the suction device.

In accordance with a further feature of the invention, the air guide funnel is integrated as an independent structural part into the partition. Alternatively, the partition and the air guide funnel form a one-piece jointly produced structural part.

In accordance with another added feature of the invention, the air guide funnel has a funnel bottom and an intervention guard element projecting in a direction of the collection chamber disposed in the funnel bottom. The intervention guard element is a dome-shaped ribbed body having gaps for a largely unobstructed routing of the air stream from the collection space through to the suction device.

In accordance with another further feature of the invention, a filter bag is disposed in the collection space for accumulating the particles.

In accordance with a concomitant feature of the invention, at least one additional filter element is provided for purifying the air stream from the collection chamber to the suction device. The additional filter element is disposed upstream of the entry surface of the air guide funnel.

Other features which are considered as characteristic for the invention are set forth in the appended claims.

Although the invention is illustrated and described herein as embodied in a device for sucking up particles to be collected and a floor vacuum cleaner, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
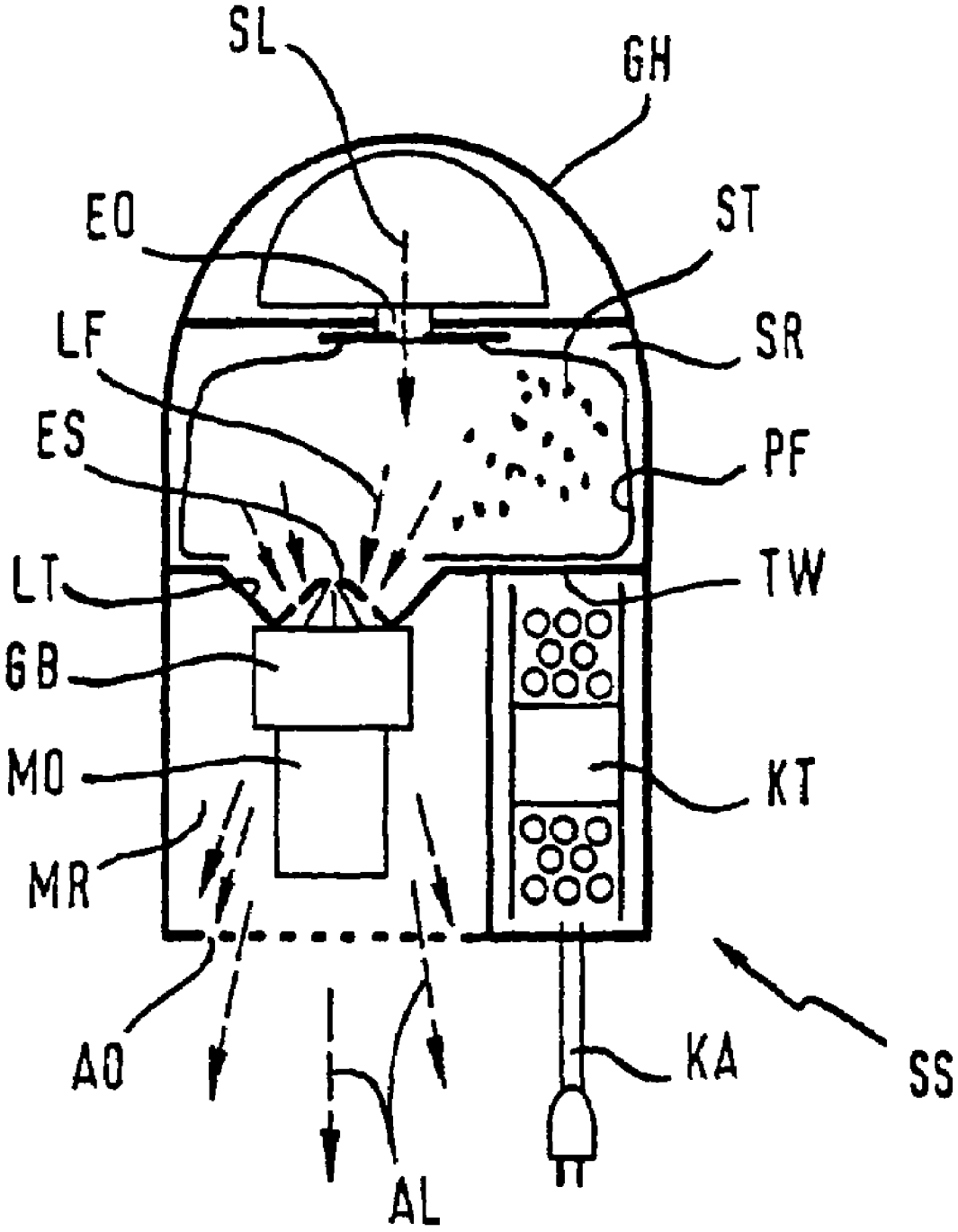
FIG. 1 is a diagrammatic, cross-sectional, top view of essential components of a vacuum cleaner that is configured and functions on the principle according to the invention.

In all the figures of the drawing, sub-features and integral parts that correspond to one another bear the same reference symbol in each case. Referring now to the figures of the drawing in detail and first, particularly, to FIG. 1 thereof, there is shown diagrammatically a top view of the configuration of essential components of a floor vacuum cleaner SS which is configured on the principle according to the invention. It has, on one end face of its housing GH, an entry orifice EO of preferably circular cross section for sucking in suction air SL. Provided in the housing GL, downstream of the entry orifice EO, is a first collection chamber or collection space SR which serves for the accumulation of particles, in particular dirt particles or dust particles, to be sucked up. Here, in the exemplary embodiment of FIG. 1, in the collection space SR a filter bag or dust bag PF serves for receiving the dirt or dust particles ST sucked into the collection chamber SR from outside through the entry orifice EO. The filter bag PF is in this case slipped internally onto the exit-side end of the approximately tubular entry orifice EO, so that particles sucked in from outside pass directly into the interior of the dust bag PF. The entry orifice EO has coupled to it, as a rule on the outside, a vacuum cleaner tube or a vacuum cleaner hose, by which, for example, dust particles can then be sucked up from a carpet.

It may be expedient, if appropriate, additionally to interpose at least one filter element, such as, for example, a filter fleece, in a collection chamber SR between the entry orifice EO and the dust bag PF.

In the housing GH of the vacuum cleaner SS of FIG. 1, a reception chamber MR is separated from the collection space or from the collection or dust chamber SR by a partition TW. The reception space MR serves, in particular, for the accommodation and mounting of a suction device, by which a directable suction air stream LF can be generated through the entry orifice EO, the collection space SR and the dust bag PF provided, if appropriate, there. In FIG. 1, in this case, the routing of the air flow LF through the interior of the housing GH of the vacuum cleaner SS is indicated by dashed arrows. Where the vacuum cleaner SS is concerned, the suction device is formed primarily by a blower GB of known type that is driven by a motor MO. Rotor blades of the blower GB are configured in such a way that they suck air from outside through the entry orifice EO into the interior of the housing GH, cause it to flow through the collection space SR, subsequently suck it away through an entry orifice in the partition TW into the reception space MR, and finally blow it outward again through exit orifices AO in the housing GH. The outflowing blow-out air is likewise indicated in FIG. 1 by dashed arrows AL. In addition to the suction device MO, GB if appropriate, further components of the vacuum cleaner, such as, for example, its cable drum KT for winding up an electrical connecting cable KA, may also be accommodated in the reception space MR.

In order, then, to make it possible to provide a sufficient suction power of the vacuum cleaner SS, even when the structural dimension is compact, the entry orifice in the partition TW is expediently provided at a location such that the air stream LF can be routed so as to be directed essentially in a straight line from the entry orifice EO through the collection space SR to the suction device GB, MO downstream of the partition TW in the reception space MR. In order to allow such controlled air routing, that is to say so that a defined predeterminable flow direction can be imparted to the sucked-in air, the inlet orifice in the partition TW is configured as an air guide funnel LT. The air guide funnel LT, starting from its entry surface in the collection space SR, narrows in the direction of the suction device GB, MO. The suction device, in particular the blower GB, is directly coupled mechanically as closely as possible to its exit orifice.

Figure 2:
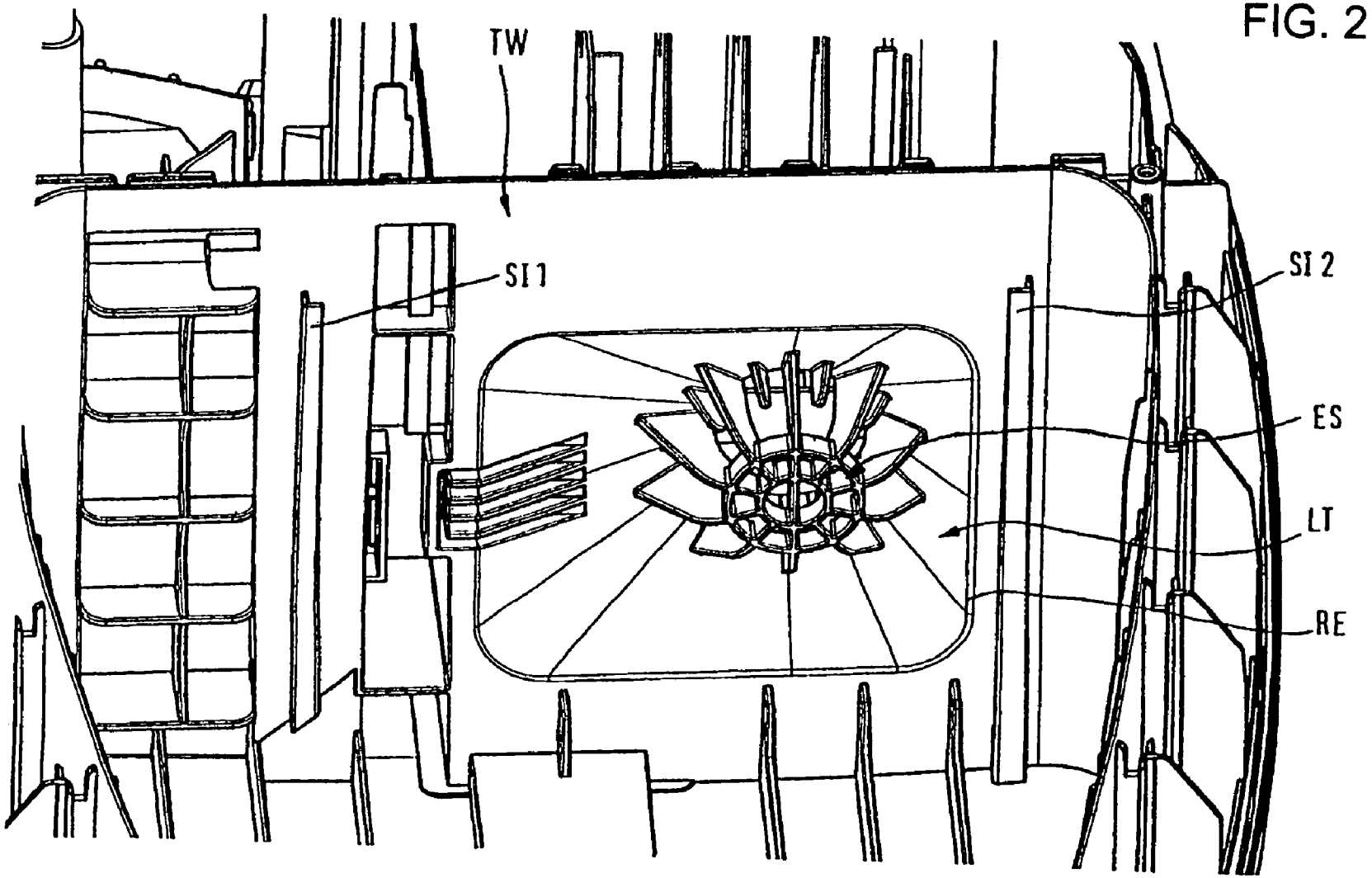
FIG. 2 is a diagrammatic perspective view of a partition between a collection chamber and a reception chamber for a suction device of the vacuum cleaner according to FIG. 1, the partition having an air guide funnel according to the invention for routing an air stream from the collection chamber to the suction device of the reception chamber.
Figure 3:
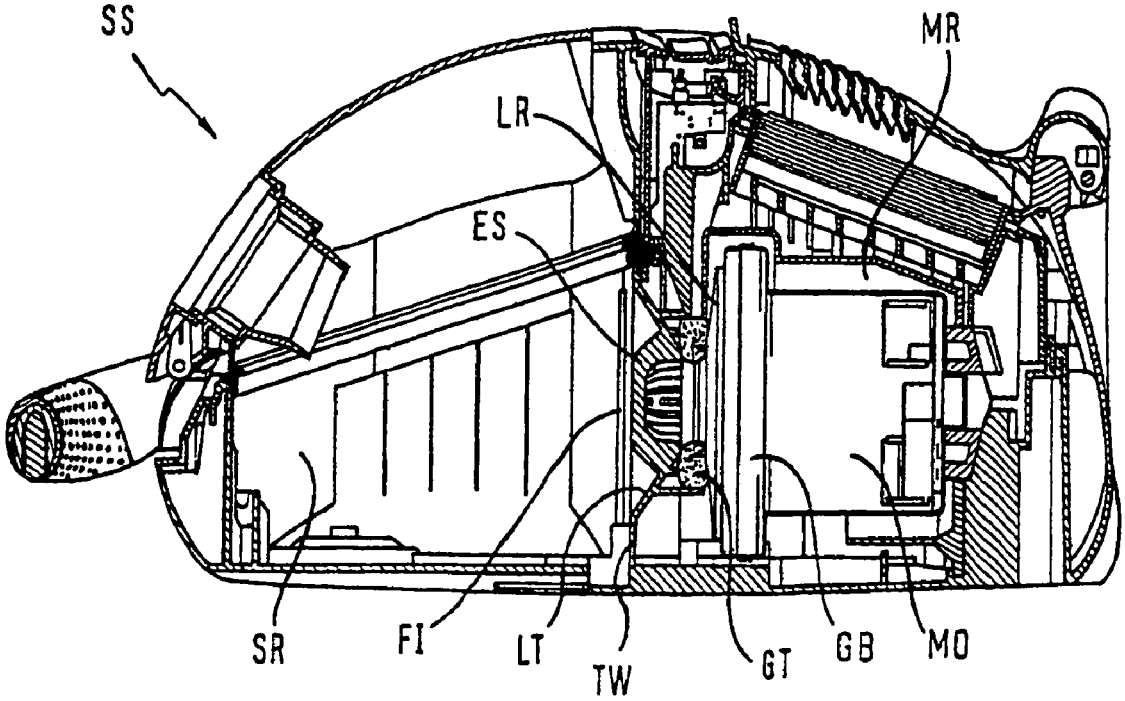
FIG. 3 is a diagrammatic side-elevational view of the configuration of the functional components of the vacuum cleaner according to the invention, as shown in FIG. 1.
Figure 4:
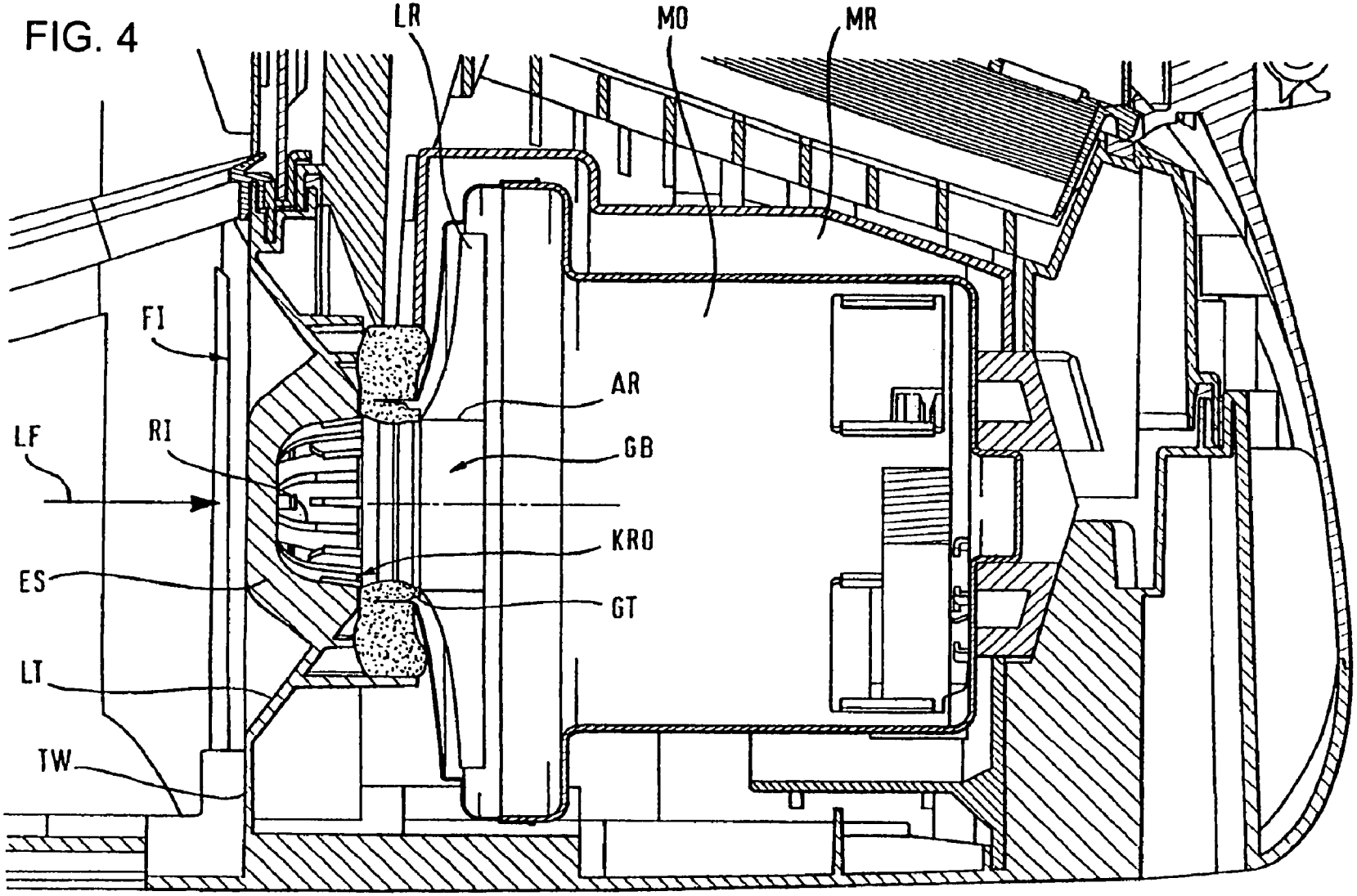
FIG. 4 is an enlarged diagrammatic cross-sectional view of a detail of the vacuum cleaner according to FIG. 3, the air guide funnel of the latter at the entrance of the suction device.

An expedient embodiment of the air guide funnel LT of FIG. 1 is shown in detail in a three-dimensional illustration in FIG. 2. There, the air guide funnel LT has an essentially rectangular entry surface RE for the air stream LF from the dust space SR. The entry surface RE of the guide funnel LT is in this case essentially flush with the otherwise preferably planar partition TW. The inner walls of the air guide funnel LT then run, starting from the rectangular outer contour, toward one another in the manner of a cone in the direction of the suction device MO, GB which are of course seated downstream of the partition TW. In this case, the inner walls of the air guide funnel LT finally form an exit orifice of approximately circular cross section for the positive coupling of the approximately circular blow-out tube of the blower GB. This form of the air guide funnel LT as a coupling component for the air stream LF between the collection chamber SR and the reception chamber MR is illustrated, enlarged, in a side view in FIG. 4 by a cross-sectional image. In this case, the interior of the air guide funnel LT ends in an approximately circular exit orifice KRO. The blower GB is coupled mechanically to the latter via end-face sealing elements GT. Impellers LR of the blower GB are in this case guided on the end face in the sealing element GT where operation causes them to be largely looped up closed together. The sealing element GT thereby forms a buffer between the respective impeller, such as, for example, LR, and the outer housing of the blower GB. These conditions are once again fully illustrated, together with the other most important components of the vacuum cleaner SS, in a side view in FIG. 3.

The air guide funnel LT, then, is advantageously configured as an entry orifice in the partition TW, in such a way that its entry surface forms the essential part of the partition surface. This may be gathered particularly from FIG. 2. Preferably, the entry surface RE of the air guide funnel LT occupies at least 50%, preferably between 70 and 80%, of the total surface of the partition TW. As a result of this large-area entry surface, a pressure drop of the air stream LF during suction into the suction device GB, MO in the reception space MR is largely avoided. The air guide funnel LT in this case, by virtue of its form narrowing in the direction of the suction device GB, MO, gives rise to a homogeneous transition for the air stream LF from the collection chamber SR to the suction device coupled to the exit orifice of the air guide funnel LT. This is because the suction tube AR of the suction device GB, MO, MR preferably has a circular cross section that is substantially smaller than the cross-sectional width of the partition TW. Moreover, the approximately conical narrowing of the air guide funnel LT brings about an additional suction effect for the air stream LF from the collection chamber SR through the partition TW into the reception space MR. Since the widening entry duct of the air guide funnel LT spreads open in the direction of the collection chamber SR, a bunching effect or a focusing of the air stream LF is additionally achieved. As a result, the air stream LF can be directed in a controlled manner through the collection chamber SR and the dust bag PF introduced there, that is to say a routing for the air stream can be determined. In particular, by the entry orifice of the air guide funnel LT being aligned correspondingly with the opposite entry orifice EO of the collection chamber SR, the air stream LF is routed essentially in a straight line. This ensures a particularly compact configuration of the components of the vacuum cleaner SS in its housing, at the same time with a high suction power. By the air guide funnel LT being spread open or widened in this way toward the collection space SR, a lower air resistance is opposed to the sucked-in air flow LF than if the entry orifice in the partition TW were merely of a circular configuration. As a result, air turbulence back into the collection space SR is also largely avoided by the air guide funnel LT. The larger the selected inflow funnel of the air guide funnel LT is in this case, the fewer undesirable reflections of the air stream LF back into the dust space SR occur and the more effectively the air flow can be sucked away from the dust space SR by the blower GB of the suction device.

If appropriate, it may also be expedient, in addition, to provide in the bottom, that is to say in the vicinity of the exit orifice of the air guide funnel LT, an intervention guard element ES projecting in the direction of the collection chamber SR. The element is preferably configured so as to be conically arched. It has, in particular, a ribbed body with gaps for allowing the air stream LF to pass through. This ribbed body is oriented in an opposite direction to the narrowing of the entry duct of the air guide funnel LT. In particular, it likewise has a funnel shape that widens in the direction of the collection chamber SR. An enlargement of the entry surface for the air stream LF can thereby likewise be achieved. An undesirable pressure loss of the air stream LF during transition from the collection chamber SR toward the suction device GB, MO is thus largely avoided. This rib-shaped intervention guard element ES prevents the operator from inadmissibly penetrating into the blower, so that, for example, hand injuries caused by the rotating blower blades are largely avoided. Owing to the special funnel shape of the intervention guard element ES acting as a motor guard grating, the free air cross section between the individual ribs can advantageously be made as large as possible, and therefore a relatively low obstruction of the air stream, in spite of this additional protective measure, can thus be achieved.

In summary, therefore, it is expedient for safety reasons to provide in the funnel center of the air guide funnel LT, that is to say toward the orifice to the blower, protective ribs in the form of a dome-like intervention guard element ES projecting in the direction of the collection chamber SR. In addition to the intervention guard element ES having a form widening in a dome-like manner in the direction of the collection chamber SR, differently shaped rib bodies may, if appropriate, also likewise fulfill a safety function.

Figure 5:
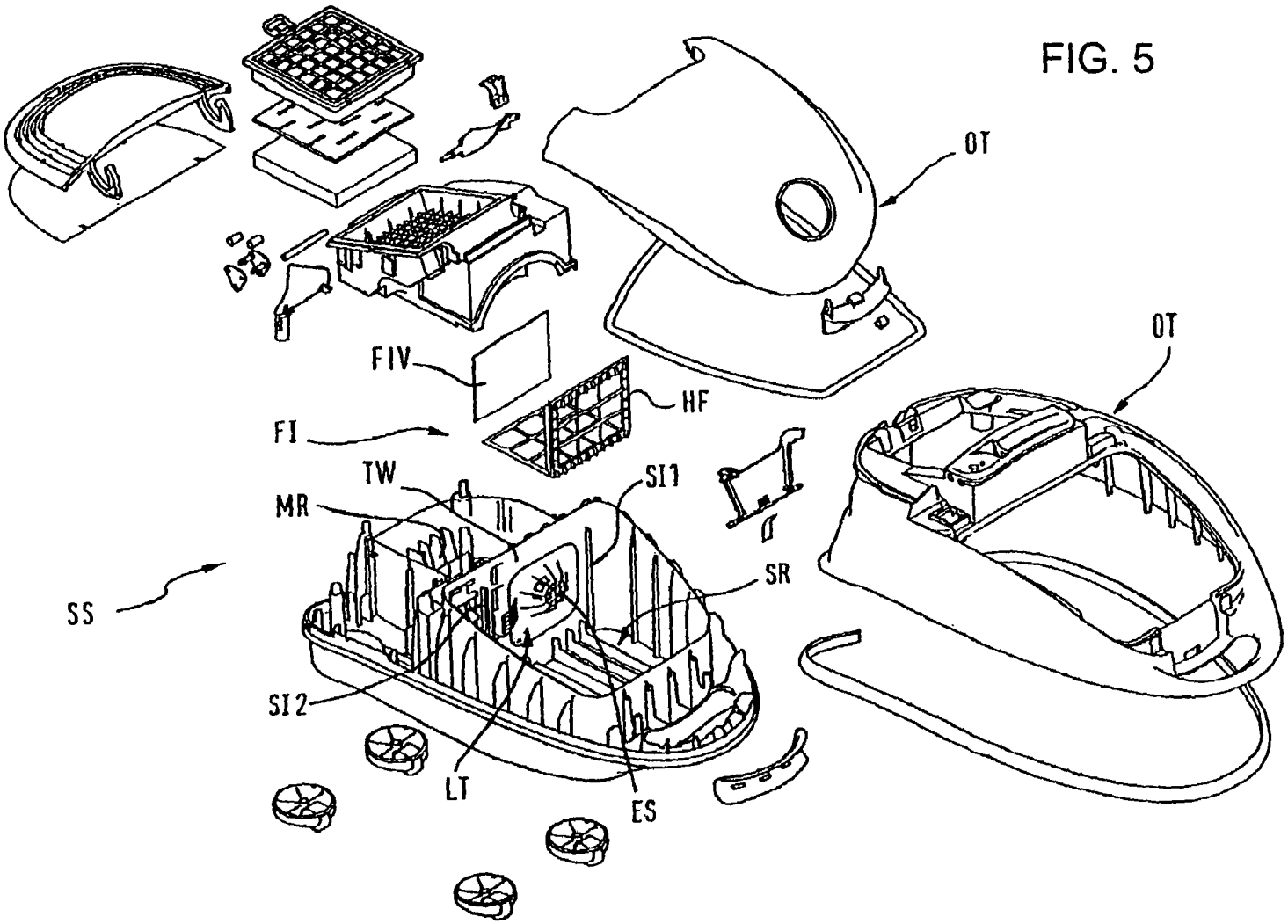
FIG. 5 is a diagrammatic, exploded perspective view of the individual components of the vacuum cleaner according to FIG. 1.

Expediently, the dome-like intervention guard element ES projects in the direction of the collection chamber SR only to an extent such that its outer contour is flush with the entry surface RE of the air guide funnel LT. As a result, advantageously, at least one filter element FI may additionally be mounted upstream of the entry orifice of the air guide funnel LT by two bracket clips SI1, SI2 disposed laterally with respect to the entry surface RE of the air guide funnel LT. The filter element FI serves for the further purification of the waste air LF that is drawn off from the dust space SR. It may be configured, in particular, as a pollen or allergen filter. One or more filter fleeces FIV are clamped there preferably between the two halves of a grip-like holding grating HF. This is illustrated in FIG. 5 where the remaining components of the vacuum cleaner are illustrated in the dismantled state.

If appropriate, it may be expedient to produce the partition TW, the air guide funnel LT and/or the attached intervention guard element ES of the latter as a one-piece structural part. It may, however, also be just as expedient to manufacture these three components as individual structural parts and then couple them mechanically to one another.

In particular, therefore, the air guide funnel LT may be integrated permanently, that is to say directly, into the plastic housing of the partition between the dust space and the motor space. On the motor space side, the motor or the associated blower is then expediently coupled to the exit orifice of the air guide funnel and sealed off via rubber parts. According to a further variant, the air guide funnel may, if appropriate, be slipped as an additional part on the motor or the blower hood. The entire unit is then coupled in the appliance body and sealed off via rubber parts of a known type. In previous types of construction, the suction air was able to pass out of the dust space into the blower only around very pronounced curves. Due to the air guide funnel, then, the air is routed in a streamlined manner out of the dust space into the blower. This air guide funnel is advantageously configured as a rectangle in the dust space in order to enlarge the entry surface. The funnel shape in this case runs preferably smoothly and without a jump in contour toward the round diameter of the blower entry orifice. For safety reasons, protective ribs may be mounted in the funnel center (the orifice to the blower). The ribbed body is in this case expediently configured in a funnel-shaped manner outward in the direction of the dust space in the opposite direction to the air guide funnel. Owing to this special funnel shape of the motor guard grating (ribbed body), the free air cross section between the individual ribs can be made as large as possible or a relatively lower obstruction of the air stream can be achieved. As a result, overall, an increase in the air power and therefore a rise in the power output of the respective vacuum cleaner become possible.

We claim:

1. A vacuum cleaner comprising:

at least one collection chamber for accumulating the particles;

a suction device;

at least one reception chamber storing said suction device;

a partition separating said collection chamber from said reception chamber and having a partition surface, said partition having an inlet orifice formed therein for channeling an air stream from said collection chamber to said suction device, said inlet orifice of said partition coupling said collection chamber to said suction device in said reception chamber;

an air guide funnel having an entry surface forming a part of said partition surface, the air guide funnel directly contacting the suction device;

an intervention guard element connected to the air guide funnel and projecting in a direction toward said collection chamber, wherein said intervention guard element is a dome-shaped rigid ribbed body having gaps formed therein for a largely unobstructed routing of the air stream from said collection space through to said suction device;

a filter bag disposed in said collection space for accumulating the particles.

2. The vacuum cleaner according to claim 1, wherein said air guide funnel is provided, with respect to said entry surface, in said partition such that an approximately straight suction air stream is provided from said collection chamber to said suction device in said reception chamber.

3. The vacuum cleaner according to claim 1, wherein said entry surface of said air guide funnel is a substantially rectangular entry surface on a same side as said collection chamber.

4. The vacuum cleaner according to claim 1, wherein said air guide funnel narrows largely continuously in a direction of said suction device.

5. The vacuum cleaner according to claim 1, wherein:

said suction device has a blower with an entry orifice formed therein; and said air guide funnel has an exit surface having a substantially circular configuration and a diameter corresponding substantially to said entry orifice of said blower of said suction device.

6. The vacuum cleaner according to claim 1, wherein said air guide funnel is integrated as an independent structural part into said partition.

7. The vacuum cleaner according to claim 1, wherein said partition and said air guide funnel form a one-piece jointly produced structural part.

8. The vacuum cleaner according to claim 1, further comprising at least one filter element for purifying the air stream from said collection chamber to said suction device, said filter element is disposed upstream of said entry surface of said air guide funnel.

9. A vacuum cleaner, comprising:

a collection chamber for accumulating particles;

a suction device including a motor and a blower generating an air flow;

a reception chamber housing the suction device;

a partition separating the collection chamber from the reception chamber and defining an inlet orifice receiving the air flow from the collection chamber;

an air guide funnel connected to the partition at the inlet orifice and extending away the collection chamber to an exit orifice, the air guide funnel directly contacting the suction device and being disposed adjacent the blower, the blower being disposed between the motor and the air guide funnel; and an intervention guard element connected to the air guide funnel and projecting in a direction toward the collection chamber.

10. The vacuum cleaner according to claim 9, wherein the air guide funnel and the partition are constructed together as a single integrally formed structural part.

11. The vacuum cleaner according to claim 9, wherein the air guide funnel, the partition, and the intervention guard element are constructed together as a single integrally formed structural part formed from the same material.

12. The vacuum cleaner according to claim 9, wherein the intervention guard element is a dome-shaped rigid ribbed body having gaps formed therein for a largely unobstructed routing of the air stream from the collection space through to the suction device.

13. The vacuum cleaner according to claim 9, further comprising a filter bag disposed in the collection space for accumulating the particles.

14. The vacuum cleaner according to claim 9, further comprising a filter element covering the inlet orifice and purifying the air flow from the collection chamber to the suction device.

15. A vacuum cleaner, comprising:

a collection chamber for accumulating particles;

a suction device including a motor and a blower generating an air flow;

a reception chamber housing the suction device;

a partition separating the collection chamber from the reception chamber and defining an inlet orifice receiving the air flow from the collection chamber;

an air guide funnel connected to the partition at the inlet orifice and extending away the collection chamber to an exit orifice disposed adjacent the blower, the blower being disposed between the motor and the air guide funnel;

an intervention guard element including a dome-shaped rigid ribbed body connected to the air guide funnel and projecting in a direction toward the collection chamber; and a filter bag disposed in the collection space for accumulating the particles.

16. The vacuum cleaner according to claim 15, wherein the air guide funnel and the partition are constructed together as a single integrally formed structural part.

17. The vacuum cleaner according to claim 15, wherein the air guide funnel, the partition, and the intervention guard element are constructed together as a single integrally formed structural part formed from the same material.

18. The vacuum cleaner according to claim 15, further comprising a filter element covering the inlet orifice and purifying the air flow from the collection chamber to the suction device.

* * * * *